US005779506A

United States Patent [19]

Okabe et al.

[11] Patent Number: 5,779,506

[45] Date of Patent: Jul. 14, 1998

[54] CONNECTOR WITH DOUBLE RETAINING MECHANISM

[75] Inventors: Toshiaki Okabe; Kimihiro Abe; Toshihiko Yamamoto; Yuji Hatagishi, all of Shizuoka, Japan

[73] Assignee: Yazaki Corporation, Tokyo, Japan

[21] Appl. No.: 755,339

[22] Filed: Nov. 22, 1996

[30] Foreign Application Priority Data

Nov. 22, 1995 [JP] Japan ..... 7-304533

[51] Int. Cl.[6] ..... H01R 13/514

[52] U.S. Cl. ..... 439/752

[58] Field of Search ..... 439/752, 746–749, 439/686, 689, 695, 696

[56] References Cited

U.S. PATENT DOCUMENTS

| | | | |
|---|---|---|---|
| 3,789,343 | 1/1974 | Hirokawa et al. | 439/746 |
| 5,141,452 | 8/1992 | Yoneda et al. | 439/752 |
| 5,261,836 | 11/1993 | Okabe | 439/752 |
| 5,316,504 | 5/1994 | Jinno | 439/752 |
| 5,419,722 | 5/1995 | Onoda | 439/752 |
| 5,607,327 | 3/1997 | Tsuji et al. | 439/752 |
| 5,647,775 | 7/1997 | Polgar et al. | 429/752 |

FOREIGN PATENT DOCUMENTS

| | | | |
|---|---|---|---|
| 0622868 | 11/1994 | France | 439/686 |
| 61-120180 | 7/1986 | Japan . | |
| 63-33176 | 2/1987 | Japan . | |
| 2-49656 | 12/1990 | Japan . | |

*Primary Examiner*—Neil Abrams
*Assistant Examiner*—Katrina Davis
*Attorney, Agent, or Firm*—Sughrue, Mion, Zinn, Macpeak & Seas, PLLC

[57] ABSTRACT

A connector with a double retaining mechanism which allows a cover member closing operation to be performed reliably as well as easily without providing a hinge portion, and allows a connecting terminal accommodated in a terminal accommodating chamber to be doubly retained reliably by a cover member. A connector with a double retaining mechanism allows a female terminal to be unreleasably retained by a release preventing lance with the female terminal inserted into a terminal accommodating chamber formed in a housing. When a cover member that covers an opening in the rear of the terminal accommodating chamber closes a rear portion of the housing, coupling portions arranged on a base end portion of the cover member are cut off while twisted. At this time, a claw arranged on the base end portion of the cover member retains the female terminal in an axial direction while confronting the inner surface of an upper wall, further, retaining lock arms arranged in the rear of the cover member are retained by engaging portions of the housing.

17 Claims, 4 Drawing Sheets

CONNECTOR WITH DOUBLE RETAINING MECHANISM

BACKGROUND OF THE INVENTION

1. Field of the Invention

This invention relates to a double retaining mechanism for a connecting terminal accommodated in a terminal accommodating chamber arranged in a connector housing. More particularly, the invention is directed to a connector with a double retaining mechanism that allows an externally inserted contact to be connected to a female terminal smoothly.

2. Background

A connector with a double retaining mechanism is disclosed in Unexamined Japanese Utility Model Publication No. Sho. 62-33176 applied by the same applicant. That is, as shown in FIGS. 4 and 5, a connector 1 with a double retaining mechanism includes a female terminal 2 having a wire W crimped onto a base plate thereof and a connector housing 3 (hereinafter referred to simply as the "housing") that accommodates the female terminal 2 therein.

As shown in FIGS. 4 and 5, the female terminal 2 has on the front end portion thereof a cylindrical connecting portion into which a contact is inserted from outside, and on the rear end portion thereof a wire crimping portion to provide electrical connection with the wire W crimped. The female terminal 2 also has a retaining lance 2*a* that allows the female terminal 2 to be retained in the housing. The retaining lance 2*a* projects outward from the back surface of the female terminal 2.

The housing 3 is formed boxlike, and has a plurality of terminal accommodating chambers 4 and a cover member 6 integrally formed therewith. Each terminal accommodating chamber is shaped to a square prismatic cell having an opening in the rear thereof. The cover member 6, which can be opened and closed, covers the openings of the terminal accommodating chambers 4 so as to confront the bottom walls 5 of the terminal accommodating chambers. A terminal pressing projection 7 projects from the inner surface of the cover member 6 so as to face each corresponding terminal accommodating chamber 4. The terminal pressing projection 7 presses the female terminal 2 accommodated in the chamber onto the bottom wall 5 so that the female terminal 2 can be fixed to the bottom wall 5 when the cover member 6 is closed. The terminal pressing projection 7 is of a rectangular prism and has dimensions so that the end face of the terminal pressing projection 7 can press the female terminal 2 from above when the cover member 6 is closed. Further, a release preventing engaging recess 13 is arranged on the bottom wall in the front of each terminal accommodating chamber 4. The engaging recess 13 retains the retaining lance 2*a* of the female terminal 2.

The cover member 6 is coupled to the housing 3 through a hinge 8 whose base end portion is thin-walled, the base end portion extending orthogonal to the female terminal 2 inserting direction. Edge portions 9 that are bent so as to be L-shaped are formed on both sides of the cover member 6. Retaining portions 10 are arranged in these bent edge portions 9 so as to engage with retaining protuberances 11 arranged so as to project from both side walls of the housing 3.

In the thus constructed connector 1, when the female terminal 2 is accommodated in the corresponding terminal accommodating chamber 4, the retaining lance 2*a* is retained in the release preventing engaging recess 13. Then, when the cover member 6 is closed, the terminal pressing projection 7 presses the female terminal 2 from above, which in turn doubly prevents the female terminal 2 from coming out. Further, at the same time, the play of the female terminal 2 inside the terminal accommodating chamber 4 can be eliminated, thereby allowing the female terminal 2 to be connected to a counterpart contact smoothly.

However, the connector 1 is of such structure that the female terminal 2 is doubly retained in the terminal accommodating chamber 4 by opening and closing the cover member 6 through the hinge 8 portion on the base end of the cover member 6 being thin-walled. As a result of this structure, the thin-walled hinge 8 is likely to be broken or plastically deformed when the female terminal is doubly retained, by external force after the female terminal has been doubly retained, or for a like reason. If the hinge 8 is broken or straightened, the retaining function performed by the cover member 6 is impaired, thereby causing the female terminal 2 to play or causing the female terminal 2 to come out of the housing 3.

SUMMARY OF THE INVENTION

The object of the invention is therefore to provide a connector with a double retaining mechanism which allows the cover member closing operation to be performed reliably as well as easily without providing a hinge portion. Furthermore, the connector with the double retaining mechanism allows a connecting terminal accommodated in a terminal accommodating chamber to be doubly retained by the cover member.

To achieve the above objective, the invention is applied to a connector with a double retaining mechanism that includes connecting terminals for providing electrical connection while connected to an external contact, a plurality of terminal accommodating chambers, a connector housing having engaging portions projecting inward from both side walls thereof, and a cover member having retaining lock arms and retaining the connecting terminals in the corresponding terminal accommodating chambers, the retaining lock arms being retained by the engaging portions when the cover member covers the openings in the rear of the terminal accommodating chambers. In such connector with a double retaining mechanism, the cover member is arranged close to an upper wall in the front of the terminal accommodating chambers, and integrally molded with the housing by coupling portions continuous to the housing on both side edges on the side of a base end portion of the cover member, and the cover member is separated from the housing when the cover member is regularly retained.

The cover member is separated from the housing by the coupling portions being cut off while twisted in association with the closing of the cover member onto the housing.

The coupling portions of the cover member are cut off by the cover member pivoting about claws toward the inner surface of the base end portion of the upper wall, the claws being arranged so as to correspond to the terminal accommodating chambers close to the base end portion on the side of the coupling portions.

The claws doubly retain the connecting terminals in a direction of engagement in association with the turning of the cover member.

Each of the coupling portions has a large diameter portion on the cover member side and a small diameter portion on the housing side.

In the thus constructed connector with a double retaining mechanism, a connecting terminal is inserted into a corresponding terminal accommodating chamber, and after the retaining lance of the connecting terminal has been retained in the release preventing recess on the housing side, the cover member is caused to pivot about a claw in the closing direction with the free end portion of the cover member held by a hand. In association with the turning of the cover member, a twisting stress is applied to the coupling portions, and the coupling portions are cut off as the cover member is further turned. When the retaining lock arms of- the cover member are retained in the engaging portions on the housing side, the claw of the cover member comes to project into the terminal accommodating chamber, which in turn implements the double retaining of the connecting terminal with the end portion of the claw. Therefore, despite the fact that the hinge portion is dispensed with, the cover member can be closed stably and the connecting terminal can be doubly retained reliably.

DETAILED DESCRIPTION OF THE PREFERRED EMBODIMENT

Figure 1:
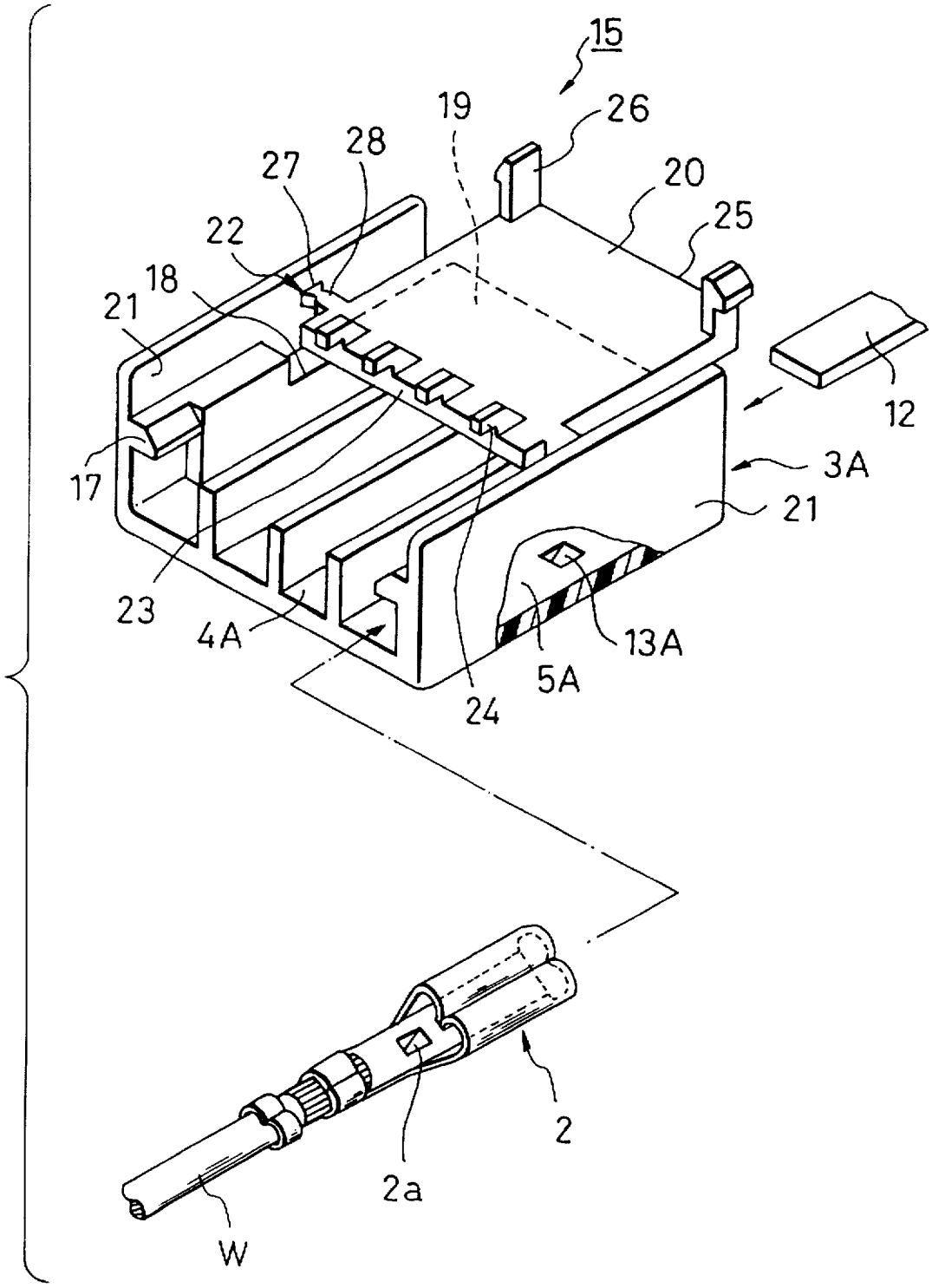
FIG. 1 is an exploded perspective view showing a connector with a double retaining mechanism, which is one mode of embodiment of the invention.

A connector with a double retaining mechanism, which is a preferred mode of embodiment of the invention, will now be described in detail with reference to FIGS. 1 to 3. It may be noted that the same parts and components as those of the conventional example are denoted as the same reference numerals for better understanding.

As shown in FIG. 1, a connector 15 with a double retaining mechanism, which is one mode of embodiment of the invention, includes a female terminal 2 having a wire W for providing electrical connection crimped thereto, a substantially boxlike housing 3A having a plurality of terminal accommodating chambers 4A juxtaposed therein, and a cover member 20 that retains the female terminal 2 within the terminal accommodating chamber 4A when openings arranged in the rear of the terminal accommodating chambers 4A are closed.

The housing 3A includes projecting engaging portions 17 that hold retaining lock arms 26 onto both side walls 21 in the rear thereof, notched portions 18 arranged in the middle thereof, and an upper wall 19 that extends only in the front so as to continue to the side walls 21 with the portion thereof in the rear opened.

A release preventing recess 13A is arranged in a bottom wall 5A of each terminal accommodating chamber 4A in this housing 3A. The release preventing recess 13A serves to unreleasably retain the female terminal 2.

Further, the female terminal 2 has a retaining lance **2*a*** that is arranged so as to project outward from the back of the base plate portion thereof.

The cover member 20 is designed to cover the openings of the terminal accommodating chambers 4A, and is integrally molded with the cover member 20 and the upper wall 19 arranged back to back, i.e., with the inner side of the cover member 20 facing upward. Coupling portions 22 are formed integrally with the housing 3A on both side edge portions of a base end portion 23 of the cover member 20. Hook-shaped claws 24 are also formed close to the base end portion 23 so as to project from the base end portion 23. The claws 24 are arranged so as to correspond to the respective terminal accommodating chambers 4A. Further, the retaining lock arms 26 are projected from both side end edges on the free end portion 25 that is opposite to the claws 24. The retaining lock arms 26 are held by the engaging portions 17.

The coupling portion 22 is structured in such a manner that the coupling portion 22 is coupled to the housing 3A so as to be continuous to both end edges of the cover member 20 on the base end portion 23 side. The coupling portion 22 includes a small diameter portion 27 that is formed by constricting the coupling portion 22 on the housing 3A side, and a large diameter portion 28 that is formed by thickening the coupling portion on the cover member 20 side. The small diameter portion 27 and the large diameter portion 28 are coupled so as to be continuous.

Figure 2:
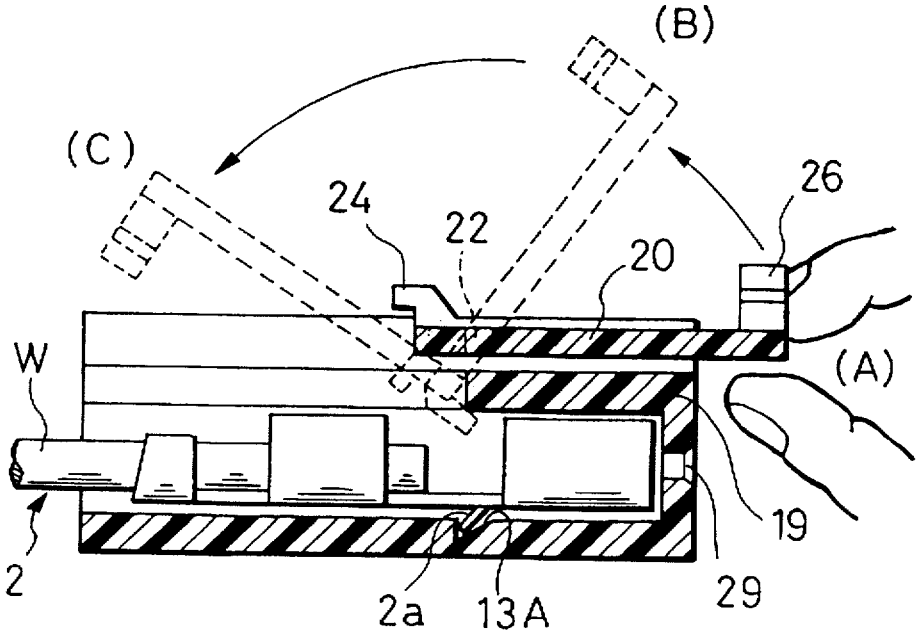
FIG. 2 is a sectional view showing a turning operation of a cover member in FIG. 1.
Figure 3:
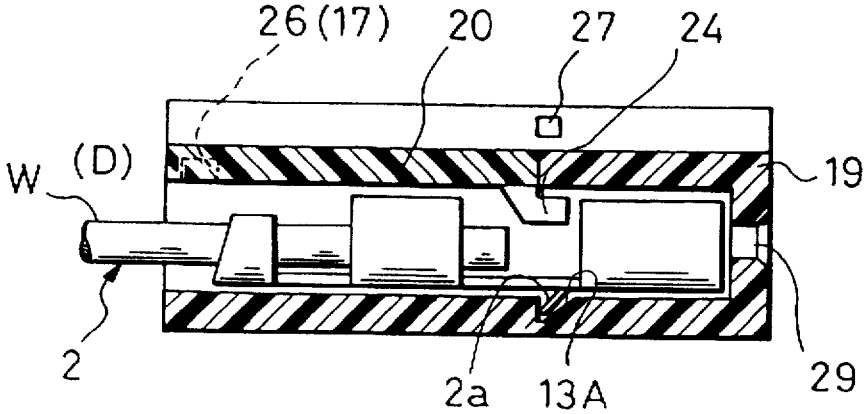
FIG. 3 is a diagram illustrative of the condition in which the cover member in FIG. 1 is completely closed.
Figure 4:
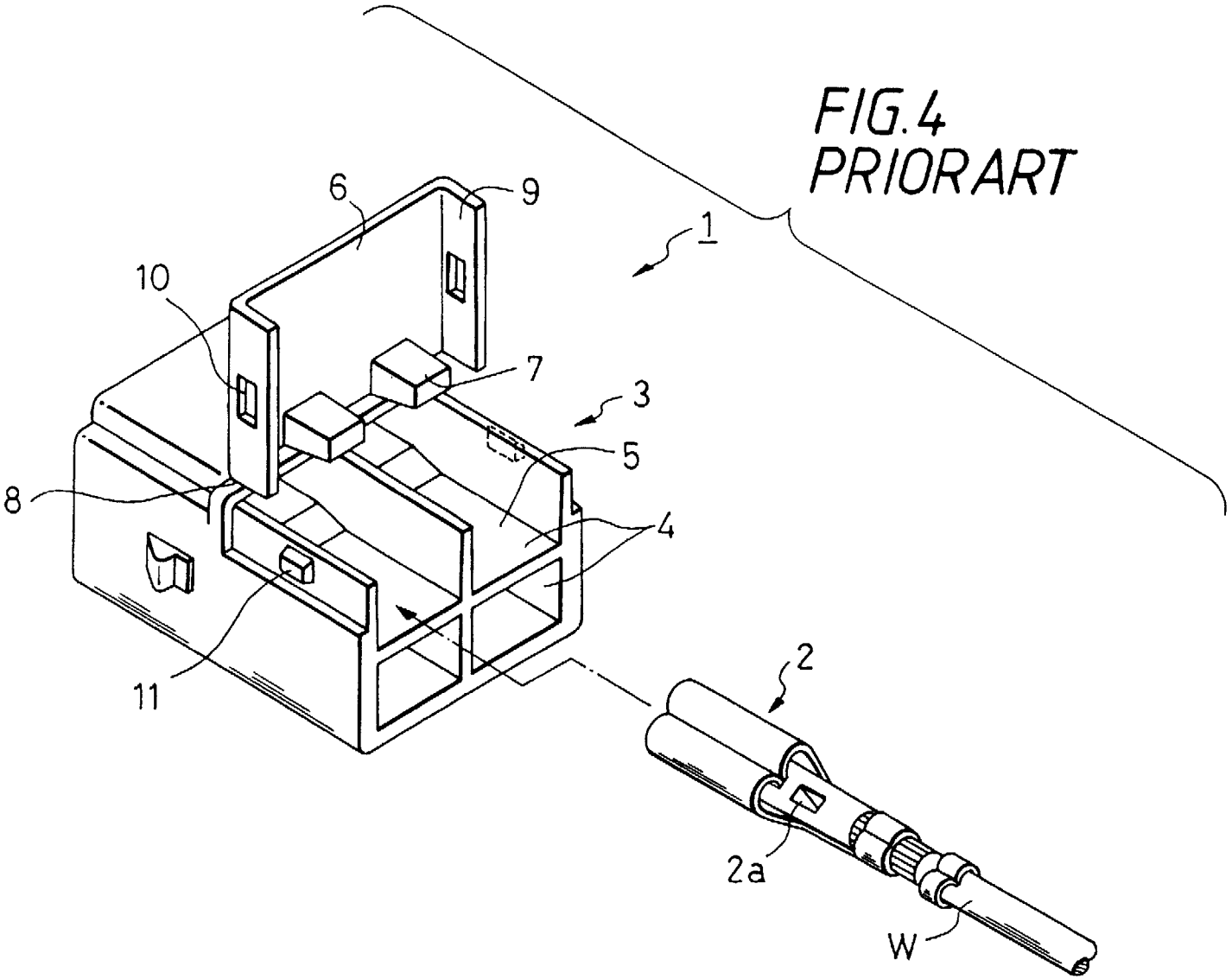
FIG.4 PRIOR ART
FIG. 4 is a perspective view of a conventional connector with a double retaining mechanism.
Figure 5:
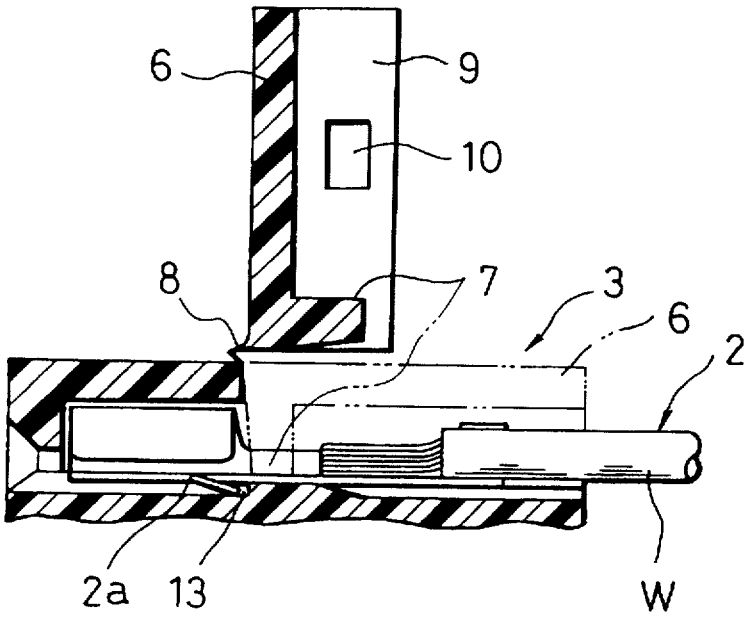
FIG. 5 PRIOR ART
FIG. 5 is a sectional view of the connector shown in FIG. 4.

In this connector 15 with a double retaining mechanism, the female terminal 2 is inserted from the opening in the rear of a terminal accommodating chamber 4A of the housing 3A as shown in FIGS. 1 and 2. The female terminal 2 is inserted in such a manner that the front end thereof faces an insertion hole 29 that allows an externally inserted contact 12 to be engaged, the insertion hole 29 being arranged in the front. At this time, a retaining lance 2A of the female terminal 2 is retained in the release preventing recess 13A arranged on the bottom wall 5A of the terminal accommodating chamber 4A, so that the female terminal 2 is blocked from coming off from the rear.

Then, as shown in FIG. 2, the cover member 20 is turned while pushing upward with the free end portion on the retaining lock arm 26 side held by the hand to change the position of the cover member 20 from position (A) to position (B). That is, the cover member 20 turns around with the coupling portions 22 as pivots, and then the small diameter portions 27 of the coupling portions 22 are twisted to be cut off as the cover member 20 is further turned. When the cover member 20 is still further turned after the coupling portions 22 have been cut off, the claws 24 come to face the inner surface of the upper wall 19 (position (C)) while turning so as to be in contact with the opening end edge of the upper wall 19 located on the back surface of the cover member 20.

When the cover member 20 is further turned from position (C) to position (D), i.e., the cover member 20 is closed, the cover member 20 becomes substantially coplanar with the upper wall 19, thereby allowing the claws 24 to project into the inner surface of the upper wall 19, and further, causing the claw 24 corresponding to the female terminal to retain the female terminal in such a manner that the front end of the claw 24 opposes the rear end of the connecting portion of the female terminal. At this time, the retaining lock arms 26 are retained by the engaging portions 17, and the large diameter portions 28 of the coupling portions 22 are engaged with the notched portions of the housing 3A.

With the cover member 20 regularly retained this way, the female terminal 2 is unreleasably retained with the release preventing recess 13A in the bottom wall 5A of the terminal accommodating chamber 4A engaged with the retaining lance **2*a* of the female terminal 2 and has the rear end portion of the connecting portion of the female terminal 2 retained by the claw 24. That is, the female terminal 2** is doubly retained within the terminal accommodating chamber 4A reliably. In addition, the cover member and the housing 3A can be integrally molded without providing a hinge portion that is vulnerable to external force. As a result, the cost of manufacture can be curtailed, and further, the cover member closing operation can be performed reliably as well as easily.

As described in the foregoing, the connector of the present invention has a double retaining mechanism on the cover member which is arranged close to the upper wall in the front of the terminal accommodating chambers, and is integrally molded with the housing through the coupling portions continuous to the housing on both side edges of the base end side of the housing. The connector also has coupling portions for separating the cover member from the housing when the cover member is moved to a closed position. The cover member separates from the housing when the coupling portions are twisted to be cut off during the process of closing the cover member onto the housing.

Moreover, the coupling portions of the cover member are cut off by the cover member pivoting about the claws in such a manner that the claws are directed toward the inner surface of the base end portion of the upper wall, the claws being arranged so as to correspond to the respective terminal accommodating chambers close to the base end portion on the coupling portion side. The claws doubly retain connecting terminals in the insertion direction in association with the turning of the cover member. In addition, each coupling portion has a large diameter portion on the cover member side and a small diameter portion on the housing side.

Therefore, when connecting terminals are inserted into the terminal accommodating chambers and the cover member is closed onto the housing, the small diameter portions of the coupling portions are cut off while easily twisted in association with the turning of the cover member with the claws as the pivots. As a result, the connecting terminals are retained in the axial direction with the claws confronting the inner surface of the upper wall, and further, the connecting terminals are doubly retained inside the terminal accommodating chambers with the retaining lock arms being retained in the engaging portions of the housing.

What is claimed is:

1. A connector, comprising:

a housing having at least two side walls;

a terminal accommodating chamber, for accommodating a terminal, formed in said housing; and a cover member, for retaining said terminal in said terminal accommodating chamber, said cover member being integrally connected to said housing by coupling portions formed on at least two side portions of said cover member, wherein when said cover member is twisted to a closed position, said coupling portions are severed.

2. The connector of claim 1, further comprising at least one claw formed on said cover member wherein said coupling portions are severed by pivoting said cover member about said claw.

3. The connector of claim 2, wherein said at least one claw is arranged so as to correspond to said terminal accommodating chamber close to a base end portion of said cover member on which said coupling portions are formed.

4. The connector of claim 3, wherein said claw retains said terminal in accordance with the pivoting of said cover member.

5. The connector of claim 1, further comprising at least one claw formed on said cover member wherein said coupling portions are severed by pivoting said cover member about said claw.

6. The connector of claim 5, wherein said at least one claw is arranged so as to correspond to said terminal accommodating chamber close to a base end portion of said cover member on which said coupling portions are formed.

7. The connector of claim 6, wherein said claw retains said terminal in accordance with the pivoting of said cover member.

8. The connector of claim 1, wherein each of said coupling portions has a large diameter portion on the cover member side and a small diameter portion on the housing side.

9. The connector of claim 1, wherein a recess, for engaging with a lance formed on said terminal, is formed in a bottom wall of said terminal accommodating chamber.

10. The connector of claim 1, wherein said at least two side walls of said housing include notched portions configured and dimensioned to receive said coupling portions when said cover member is in its closed position to thereby aid in retaining said cover member on said housing.

11. The connector of claim 1, further comprising engaging portions on said at least two side walls of said housing.

12. The connector of claim 11, wherein the engaging portions project from inner surfaces of the side walls of the housing toward the terminal accommodating chamber.

13. The connector of claim 11, further comprising lock arms formed on said cover member to engage with said engaging portions of said housing when said cover member, in its closed position, covers an opening in a rear portion of said terminal accommodating chamber.

14. The connector of claim 1, wherein the cover member is arranged close to an upper wall in a front portion of said terminal accommodating chamber.

15. The connector of claim 2, wherein the at least one claw engages an upper wall in a front portion of said terminal accommodating chamber as said cover is pivoted to its closed position.

16. The connector of claim 5, wherein the at least one claw engages an upper wall in a front portion of said terminal accommodating chamber as said cover is pivoted to its closed position.

17. The connector of claim 1, wherein the coupling portions are connected to the side walls of the housing.

* * * * *